US011154455B2

(12) United States Patent
Ahn

(10) Patent No.: US 11,154,455 B2
(45) Date of Patent: Oct. 26, 2021

(54) PORTABLE MASSAGE DEVICE

(71) Applicant: Byong Yul Ahn, Seoul (KR)

(72) Inventor: Byong Yul Ahn, Seoul (KR)

( * ) Notice: Subject to any disclaimer, the term of this patent is extended or adjusted under 35 U.S.C. 154(b) by 151 days.

(21) Appl. No.: 16/574,168

(22) Filed: Sep. 18, 2019

(65) Prior Publication Data

US 2020/0085684 A1 Mar. 19, 2020

(30) Foreign Application Priority Data

Sep. 19, 2018 (KR) ..... 10-2018-0111989
Aug. 14, 2019 (KR) ..... 10-2019-0099302

(51) Int. Cl.
*A61H 39/04* (2006.01)
*A61H 39/06* (2006.01)
*A61H 23/02* (2006.01)

(52) U.S. Cl.
CPC ..... *A61H 39/04* (2013.01); *A61H 23/0218* (2013.01); *A61H 39/06* (2013.01); *A61H 2201/0157* (2013.01); *A61H 2201/0188* (2013.01); *A61H 2201/10* (2013.01); *A61H 2201/1207* (2013.01)

(58) Field of Classification Search
CPC ..... A61H 23/00; A61H 23/006; A61H 23/02–0263; A61H 39/002–086; A61H 2201/0157; A61H 2201/1207; A61H 2201/1215–123; A61H 2039/005; A61H 2023/002; A61H 2023/0272–029; A61H 1/006; A61H 1/008; A61H 1/001–005; A61H 15/00–02; A61H 2015/007–0071; A61H 7/00–008; A61H 2007/009; A61H 21/00; A61H 39/00–50; A61N 2/002; A61N 2/008; A61N 2/06; A61F 7/007; A61F 2007/087; A47C 21/06; A47D 9/02; B62B 9/22; B05B 1/16; H02K 7/06–061
See application file for complete search history.

(56) References Cited

U.S. PATENT DOCUMENTS 6,812,607 B1 * 11/2004 Sun ..... H02K 7/063 310/81

FOREIGN PATENT DOCUMENTS

KR 101336063 B1 * 12/2013

* cited by examiner

*Primary Examiner* — Valerie L Woodward
*Assistant Examiner* — Paige Kathleen Bugg
(74) *Attorney, Agent, or Firm* — Amster, Rothstein & Ebenstein LLP

(57) ABSTRACT

An improved portable massage device includes a first housing including a plurality of acupressure protrusions formed on an upper surface thereof and spaced apart from each other. The portable massage device further includes a battery supplying power, a motor connected to the battery to be turned on/off, and a rotating member mounted to surround the motor. In addition, the portable massage device includes a shield plate provided on the rotating member, at least one magnet detachably attached to the shield plate so that the shield plate vibrates when the motor rotates, a case accommodating the motor, a first switch connected to and controlling the battery to be turned on/off, and a second housing detachably combined with the first housing. The battery and the case are accommodated in the first housing or the second housing.

15 Claims, 16 Drawing Sheets

PORTABLE MASSAGE DEVICE

CROSS-REFERENCE TO RELATED APPLICATION(S)

This application is based on and claims priority under 35 U.S.C. 119 to Korean Patent Application No. 10-2018-0111989, filed on Sep. 19, 2018 and Korean Patent Application No. 10-2019-0099302, filed on Aug. 14, 2019, in the Korean Intellectual Property Office, the disclosures of which are herein incorporated by reference in their entireties.

TECHNICAL FIELD

The disclosure relates to a portable massage device. In particular, the disclosure relates to a portable massage device that has a thin, compact, and ultra-lightweight structure to be portable, convenient, and easy to use, and also provides sufficient effects of massage, blood circulation, and thermal poultice on a user's affected part or pain part for a long time.

BACKGROUND

In general, portable massage devices having a motor and a magnet have been well known and widely used. One of typical portable massage devices has been disclosed in Korean Patent Application No. 10-2012-0070876 filed on Jun. 29, 2012 under the title of "portable massage device" by an inventor of the present application and registered as Korean Patent No. 10-1336063 on Nov. 27, 2013.

Specifically, FIG. 1A is a perspective view of a typical portable massage device, and FIG. 1B is an exploded perspective view of the portable massage device shown in FIG. 1A.

Referring to FIGS. 1A and 1B, the portable massage device 101 includes a motor 20, a housing 10 accommodating the motor 20, a rotating body 23 axially coupled to a rotating shaft 21 of the motor 20, and magnets 24 eccentrically installed on both sides of the rotating body 23 to have a vertical rod shape. In addition, the portable massage device 101 includes a cap 30 combined with the housing 10 to cover the rotating body 23 and the magnets 24, a heating plate 35 installed above the cap 30, and a heating element 40 attached to an inner surface of the heating plate 35. Also, the portable massage device 10 may further include acupressure protrusions 32 formed along an upper edge of the cap 30 at regular intervals.

The portable massage device 101 is capable of massaging a person's pain part or affected part through vibration and magnetic force generated when the eccentrically installed magnets 24 are rotated by the rotating motor 20 receiving power from a battery 50. In addition, the heating plate 35 can apply, as a poultice, heat to the pain part or affected part, and the acupressure protrusions 32 composed of LED elements installed along the upper edge of the cap 30 can indicate an operating state of the massage device 101 and also exert an acupressure effect on the pain part or affected part.

However, the above-described portable massage device 101 has problems that because the magnet 24 is formed in a rod shape vertically long on both sides of the rotating body 23, the area where the magnetic field of the magnet 24 is applied to the pain part or affected part is small, and also the effect of blood circulation or wound healing is not great in the massage function of the acupressure protrusion 32.

In addition, in the above-described portable massage device 101, the battery 50 for supplying power to the motor 20 is provided separately from the housing 10 of the portable massage device 101 and detachably connected to the bottom of the housing 10 via a jack. Thus, the portable massage device 101 has problems that in order to use the portable massage device 101, the battery 50 should be separately carried at all times and manually connected to the housing 10 at each time of use. This causes inconvenience in use.

Also, in the above-described portable massage device 101, the housing 10 and the cap 30 are vertically combined with each other, so that the number of the acupressure protrusions 32 arranged on the cap 30 is small and the area of the heating plate 35 is small. Thus, in case of the portable massage device 101, a considerable time in use is required to obtain a sufficient massage effect when the pain part or the affected part is wide, and there is a certain limit to achieve a sufficient thermal poultice effect.

Meanwhile, the present inventor has developed a multi-purpose composite portable device having a massage function. This device has been disclosed in Korean Patent Application No. 10-2016-0028077 filed on Mar. 9, 2016 under the title of "an improved multi-purpose complex portable device" by the present inventor and registered as Korean Patent No. 10-1818546 on Jan. 9, 2018.

FIG. 2A is an exploded top perspective view of a typical multi-purpose complex portable device when viewed from above, and FIG. 2B is an exploded bottom perspective view of the multi-purpose complex portable device shown in FIG. 2A when viewed from below.

Referring to FIGS. 2A and 2B, the multi-purpose complex portable device 200 includes a shaft accommodating part 221 fastened to a rotating shaft 254 extended above a motor 250, and a pair of magnetic members 222 detachably and eccentrically provided under the shaft accommodating part 221.

Because of including the pair of magnetic members 222 detachably and eccentrically provided under the shaft accommodating part 221 of the motor 250, the multi-purpose complex portable device 200 generates vibration through a rotation of the pair of magnetic members 222 in an eccentric state while the motor 250 is driven. Thus, a plurality of acupressure protrusions 246 provided on an outer upper portion of a second upper cover 240 also vibrate and thereby perform a massage function on a user's skin or affected part. At the same time, a magnetic field generated by the pair of magnetic members 222 is applied to the skin or affected part to perform functions of body waste decomposition, smooth blood circulation, skin improvement, and/or treatment.

The above-described multi-purpose complex portable device 200 has advantages of performing various functions such as a function of a portable massage device, a function of an electric shaver, and a function of a fluff remover. Nevertheless, the multi-purpose portable device 200 still has the following problems.

Specifically, the multi-purpose complex portable device 200 needs increases in size and weight to have the above-mentioned various functions, so that it is difficult for the user to grip and use the device for a long time.

Even though the multi-purpose complex portable device 200 may have a strap or the like for the user to wear the device on his/her shoulder or the like without gripping the device, it is still inconvenient for the user (especially, the elderly user) to use the device 200 of considerable size and weight for a long time.

Also, in order to improve the massage function, the multi-purpose complex portable device 200 requires an increase in the number of magnetic members 222. This will further increase the size and weight of the multi-purpose complex portable device 200.

Accordingly, a new solution for solving the above-described problems is required.

SUMMARY

The disclosure provides a portable massage device that solves the above-described problems. According to the disclosure, the portable massage device has a thin, compact, and ultra-lightweight structure to be portable, convenient, and easy to use, and also provides sufficient effects of massage, blood circulation, and thermal poultice on a user's affected part or pain part for a long time.

According to various embodiments of the disclosure, a portable massage device includes a first housing including a plurality of acupressure protrusions formed on an upper surface thereof and spaced apart from each other. The portable massage device further includes a battery supplying power, a motor connected to the battery to be turned on/off, and a rotating member mounted to surround the motor. In addition, the portable massage device includes a shield plate provided on the rotating member, at least one magnet detachably attached to the shield plate so that the shield plate vibrates when the motor rotates, a case accommodating the motor, a first switch connected to and controlling the battery to be turned on/off, and a second housing detachably combined with the first housing. The battery and the case are accommodated in the first housing or the second housing.

The portable massage device according to various embodiments of the disclosure has the following advantages. 1) The portable massage device has a thin, compact, and ultra-lightweight structure, thus being portable, convenient, and easy to use. 2) The portable massage device can provide sufficient effects of massage, blood circulation, and thermal poultice. 3) The portable massage device can be used without requiring a user's grip because of the thin, compact, and ultra-lightweight structure, and also can be used on a user's affected part or pain part for a long time because of reduced power consumption. 4) Because the motor, the rotating member, and the shield plate with the magnet attached, which are main components of the portable massage device, are provided in one standardized case, it is possible to realize modularization of such components. 5) The portable massage device has a great reduction in manufacturing cost and time, and therefore a mass production is possible.

Additional advantages of the portable massage device will become apparent from the following description with reference to the accompanying drawings, wherein like or similar reference numerals indicate like elements.

DETAILED DESCRIPTION

Hereinafter, embodiments of the disclosure will be described in detail with reference to accompanying drawings.

Figure 1A:
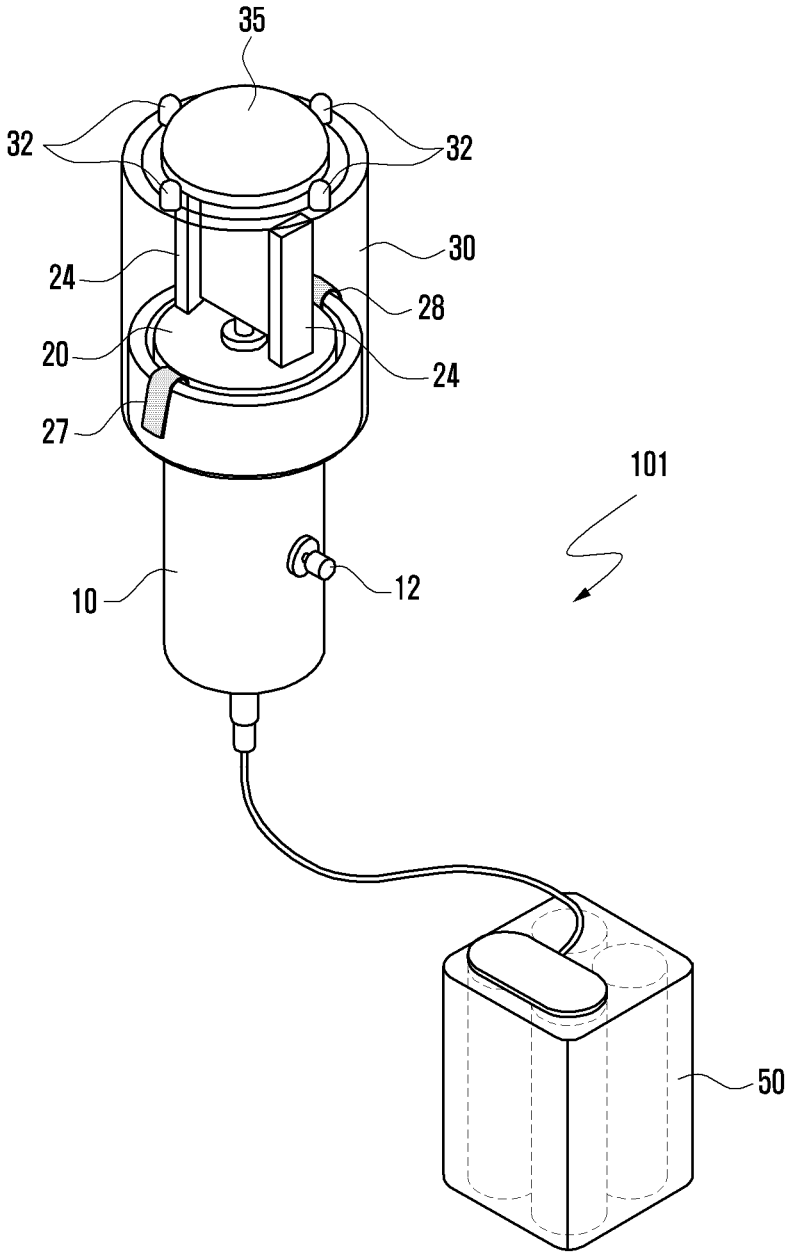
FIG. 1A is a perspective view of a typical portable massage device.
Figure 1B:
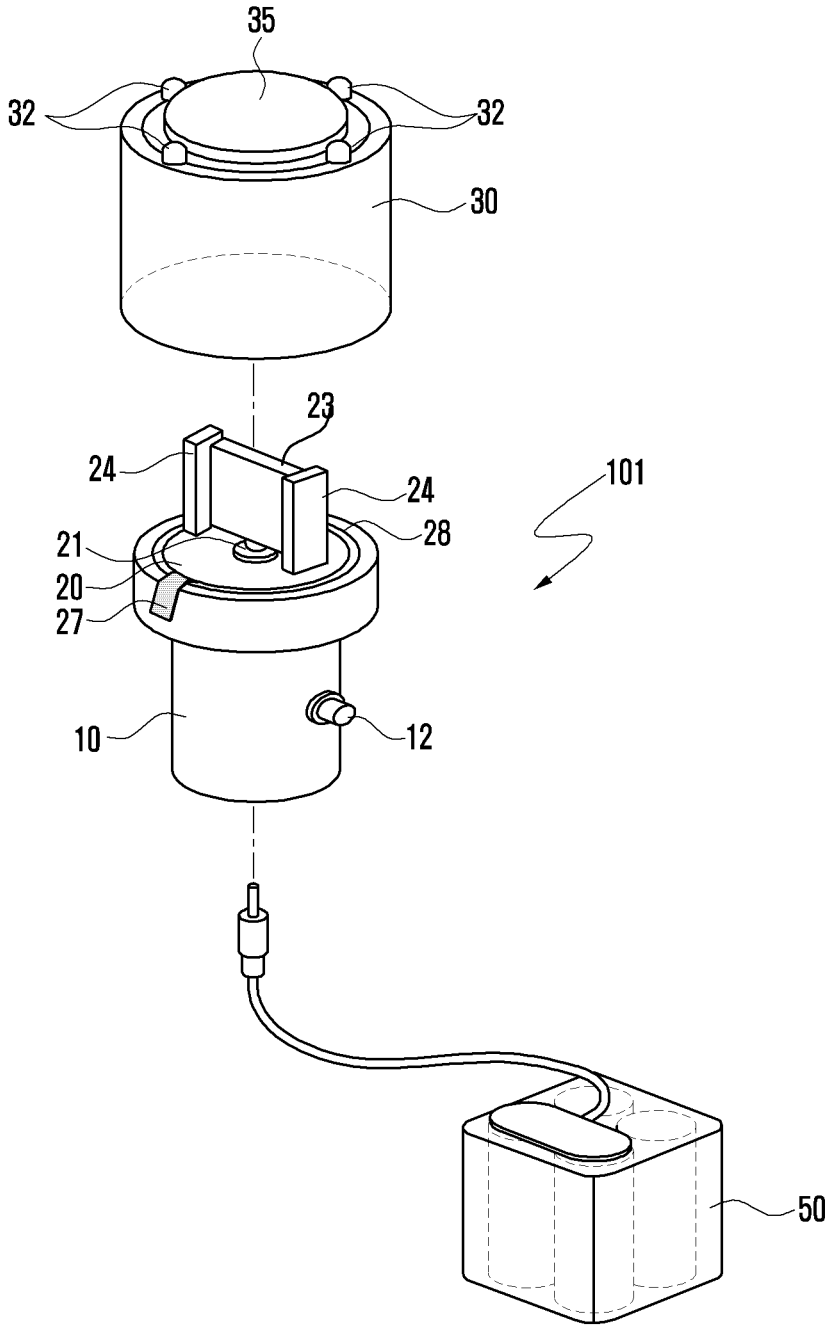
FIG. 1B is an exploded perspective view of the portable massage device shown in FIG. 1A.
Figure 2A:
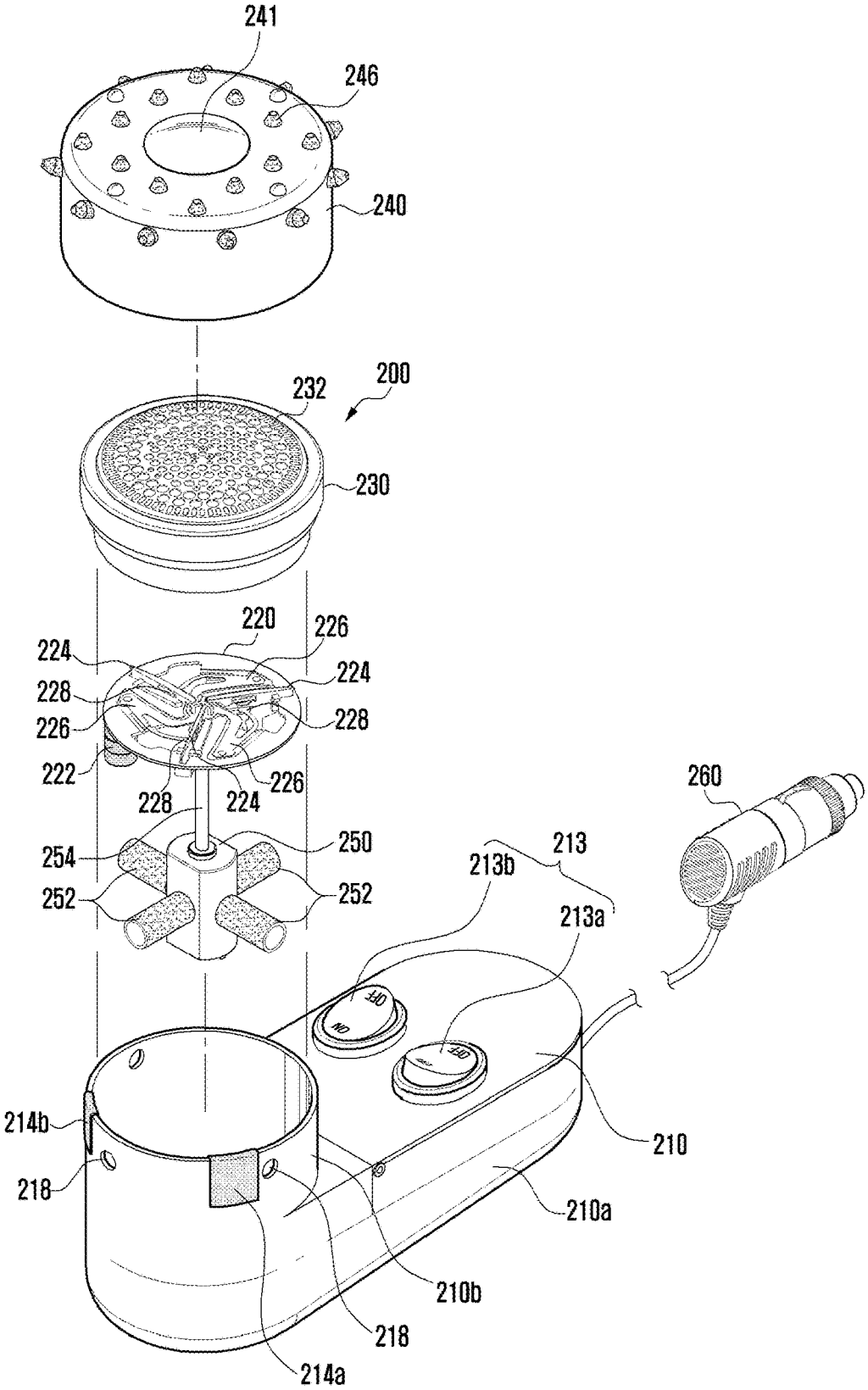
FIG. 2A is an exploded top perspective view of a typical multi-purpose complex portable device when viewed from above.
Figure 2B:
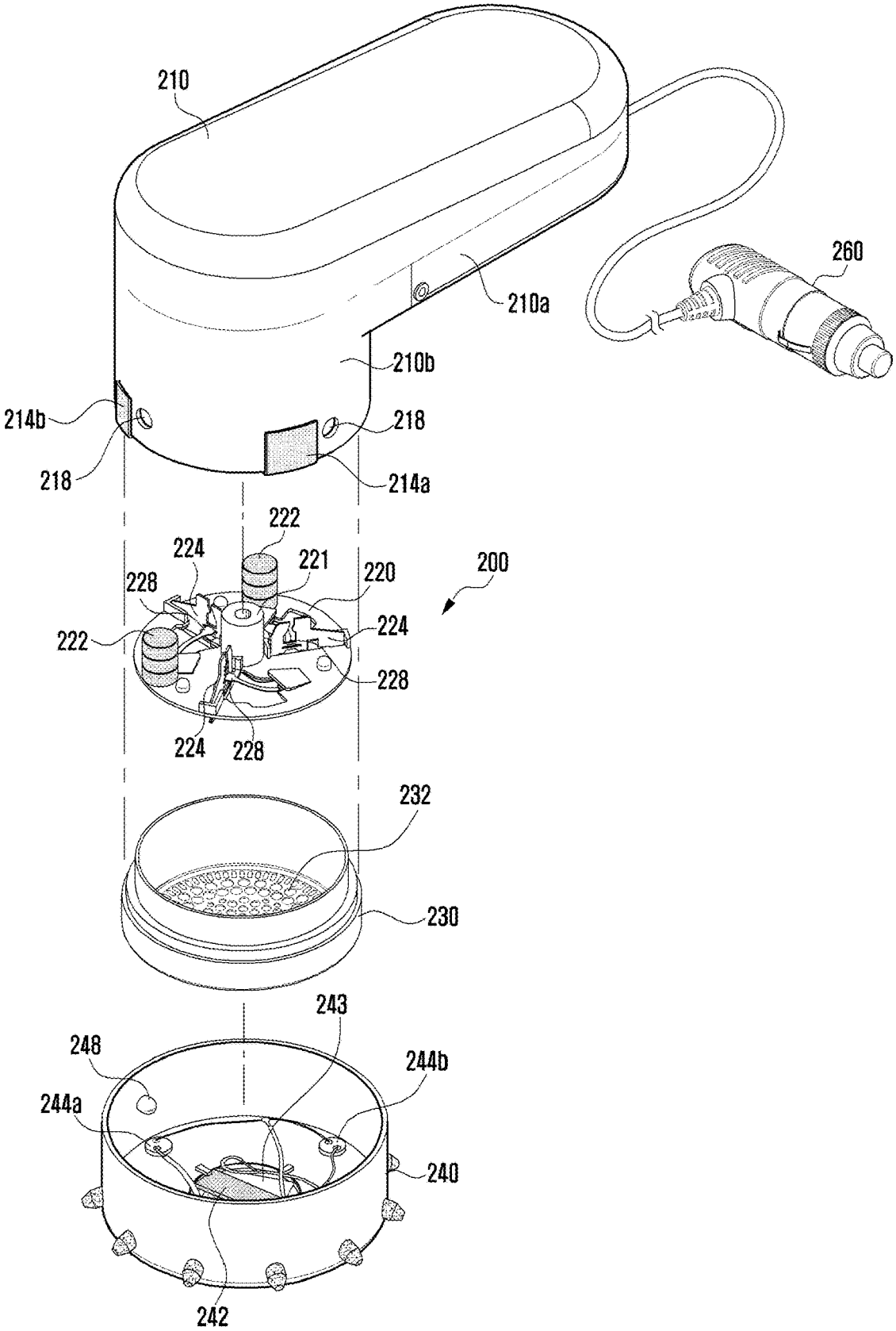
FIG. 2B is an exploded bottom perspective view of the multi-purpose complex portable device shown in FIG. 2A when viewed from below.
Figure 3:
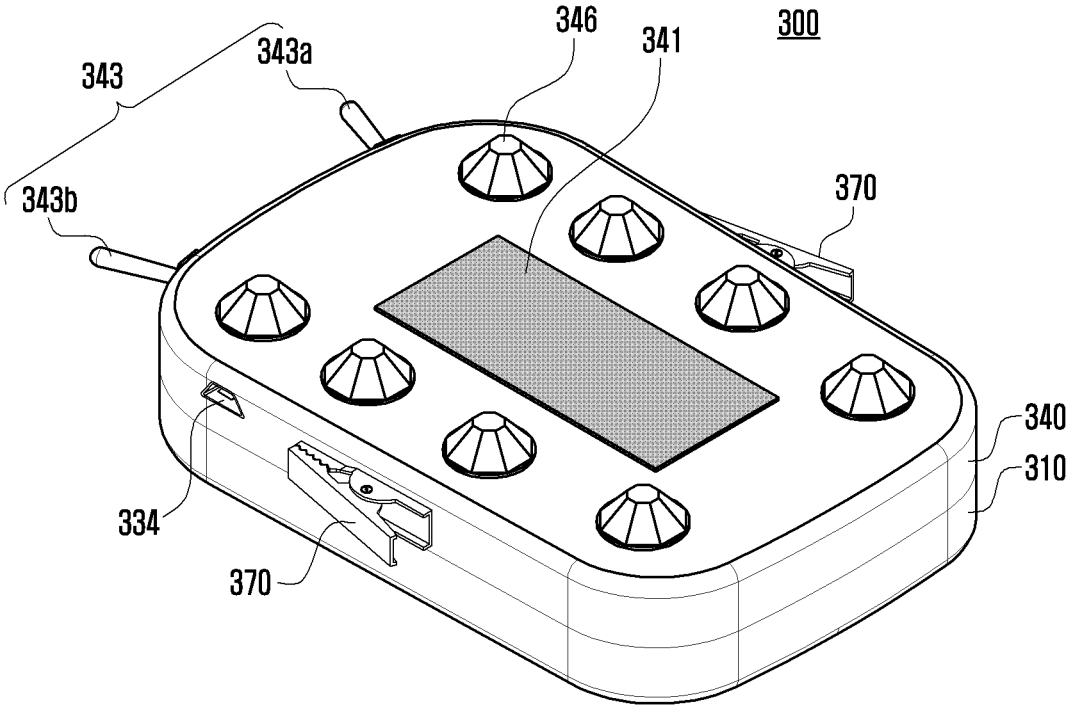
FIG. 3 is a perspective view of a portable massage device according to an embodiment of the disclosure.
Figure 4:
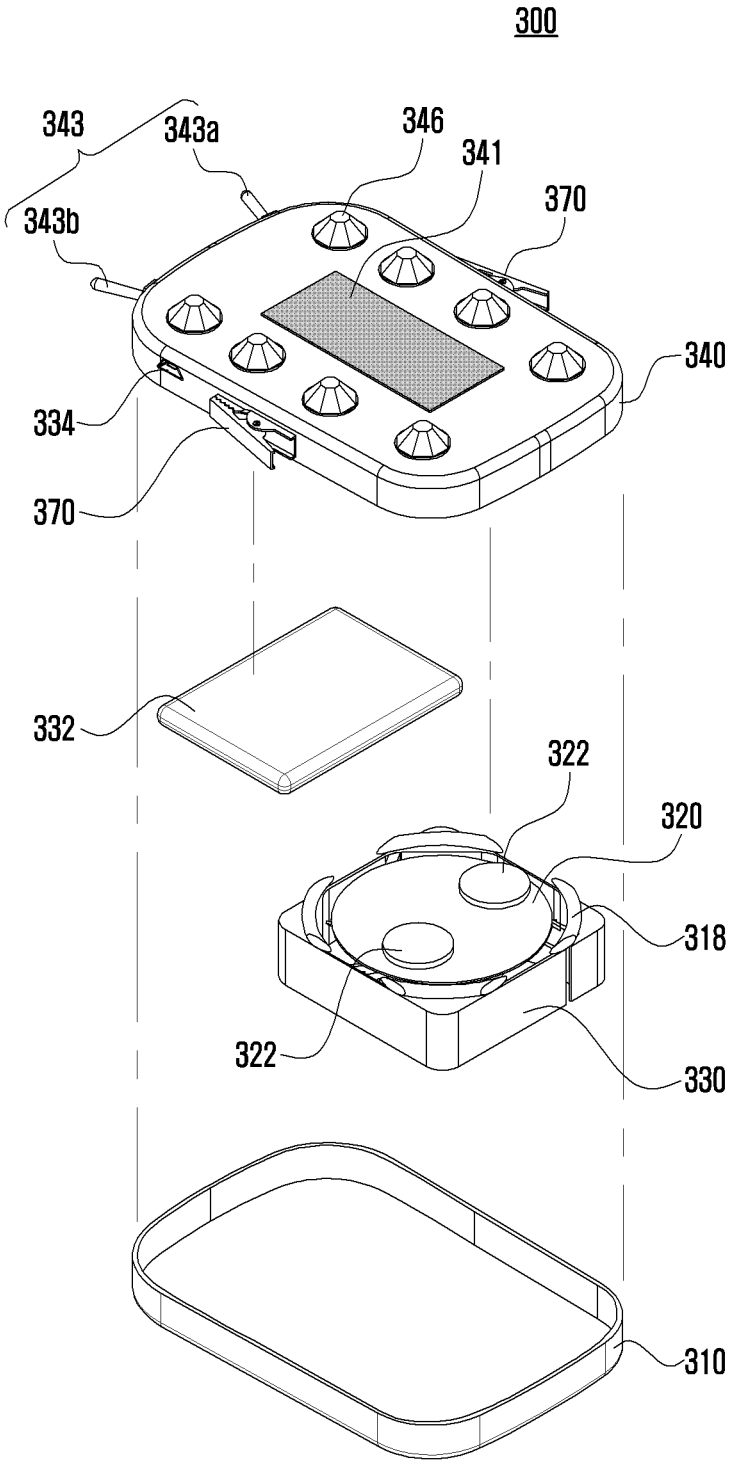
FIG. 4 is an exploded perspective view of the portable massage device shown in FIG. 3.
Figure 5:
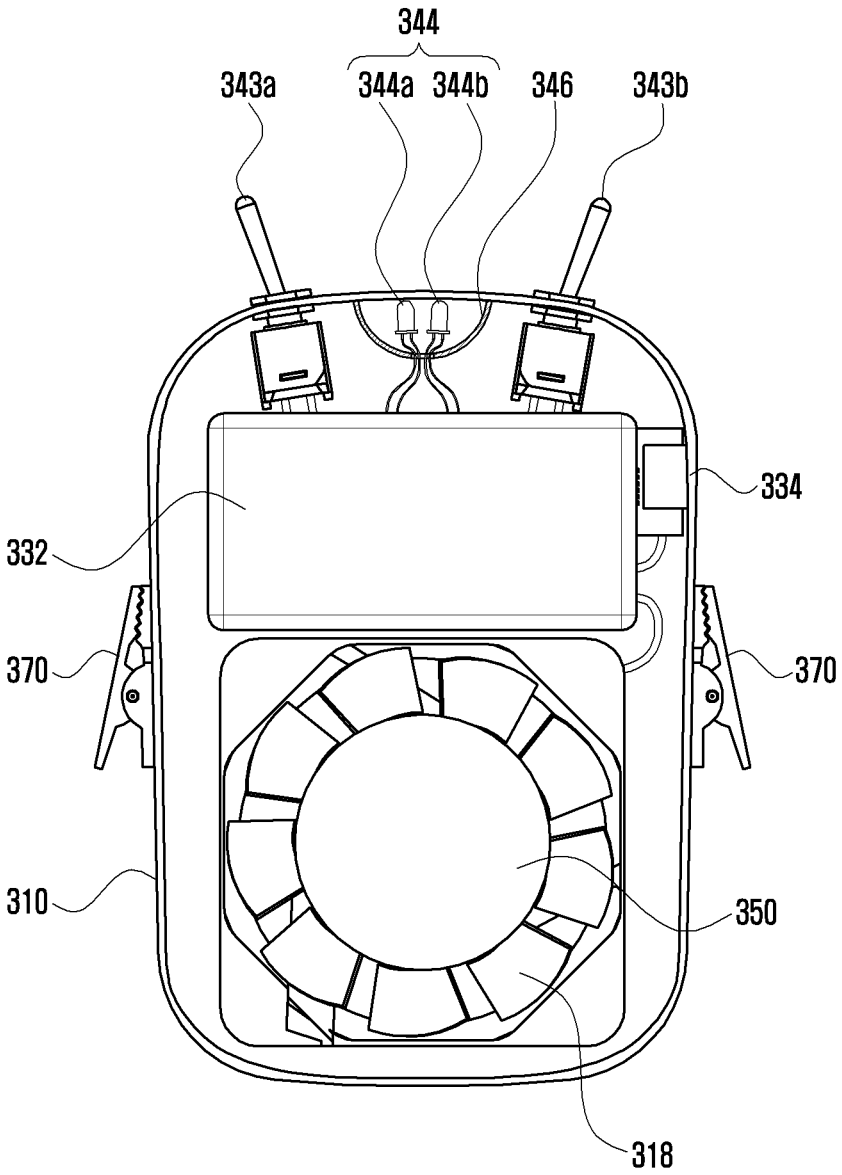
FIG. 5 is a bottom view of the portable massage device shown in FIG. 3 with a bottom cover removed.

FIG. 3 is a perspective view of a portable massage device according to an embodiment of the disclosure. FIG. 4 is an exploded perspective view of the portable massage device shown in FIG. 3. FIG. 5 is a bottom view of the portable massage device shown in FIG. 3 with a bottom cover removed.

Referring to FIGS. 3 to 5, a portable massage device 300 according to an embodiment of the disclosure includes a first housing 340, a battery 332, a motor 350, a rotating member 318, a shield plate 320, magnets 322, a case 330, a first switch 344*a*, and a second housing 310. The first housing 340 includes a plurality of acupressure protrusions 346 formed on an upper surface thereof and spaced apart from each other. The battery 332 supplies power, and the motor 350 is connected to the battery 332 to be turned on/off. The rotating member 318 is mounted to surround the motor 350, and the shield plate 320 is provided on the rotating member 318. The magnets 322 are detachably attached to the shield plate 320 so that the shield plate 320 vibrates when the motor 350 rotates. The case 330 accommodates the motor 350, and the first switch 344*a* is connected to and controls the battery 332 to be turned on/off. The second housing 310 is detachably combined with the first housing 340. The battery 332 and the case 330 are accommodated in the first housing 340 or the second housing 310.

In the portable massage device 300, the plurality of acupressure protrusions 346 may be implemented as LED devices capable of intermittent light emission, for example, and may be connected to the battery 332. In this case, when the battery 332 is turned on by the first switch 343*a*, the plurality of acupressure protrusions 346 connected to the battery 332 may intermittently emit light.

The case 330 may be implemented to have a standardized size to accommodate the motor 350, the rotating member 318, and the shield plate 320 to which the magnets 322 are attached. Therefore, it is possible to realize modularization of the motor 350, the rotating member 318, and the shield plate 320 with the magnets 322 attached, which are main components that constitute the portable massage device 300.

In addition, the portable massage device 300 may further include a heating plate 341 provided on the upper surface of the first housing 340. Alternatively or additionally, the heating plate 341 may be provided on the bottom surface of the second housing 310. The heating plate 341 is connected to a second switch 343*b* through the battery 332, and can be turned on/off by using the second switch 343*b*.

A switch 343 composed of the first switch 343*a* and the second switch 343*b* is provided on one side of the first housing 340 as shown. Alternatively, the switch 343 may be provided on one side of the second housing 310.

As shown, the switch 343 is a handle type switch. Alternatively, any other type switch such as a button type switch may be used.

In addition, the portable massage device 300 may further include a first indicator 344*a* connected to both the first switch 343*a* and the battery 332, and a second indicator 344*b* connected to both the second switch 343*b* and the battery 332. Each of the first indicator 344*a* and the second indicator 343*b* may be implemented as, for example, an LED device or a micro lamp. When the first switch 343*a* turns on the battery 332 to rotate the motor 350, the first indicator 344*a* may emit light to indicate a normal operation state of the motor 350. When the second switch 343*b* turns on the battery 332 to generate heat in the heating plate 341, the second indicator 344*b* may emit light to indicate a normal operation state of the heating plate 341. The first and second indicators 344*a* and 344*b* may emit light of different wavelengths, but it is not limited thereto. The first and second indicators 344*a* and 344*b* may perform a function of a light source at night or in a dark place. In this case, the portable massage device 300 may further include a reflective plate 347 behind the first and second indicators 344*a* and 344*b* such that the light emitted from the first and second indicators 344*a* and 344*b* is focused and emitted in one direction.

In the portable massage device 300, the battery 332 may be a replaceable battery or a rechargeable battery. When the rechargeable battery is used, the battery 332 may include a charging terminal 334 for connection with an external power source.

Meanwhile, the portable massage device 300 may further include at least one clamp 370 provided on the side of the first housing 340. The at least one clamp 370 is used to attach the portable massage device 300 to, for example, a user's clothes, socks, hair, or a hat, to hang it on a string, or to put it in a pocket or the like. Thus, the user does not need to maintain a grip state for using the portable massage device 300, and is allowed to use it conveniently for a long time while wearing the device on a part of the user's body (particularly, a body part such as a back or a hip joint that is difficult for the user to reach or grip with hand). The at least one clamp 370 may be alternatively or additionally provided on the side of the second housing 310.

The second housing 310 may have a mirror (not shown, 312 in FIG. 13 to be described later) attached on a surface thereof. The mirror may be produced by cutting a mirror sheet. Alternatively or additionally, such a mirror may be provided on a surface of the first housing 340.

Figure 6:
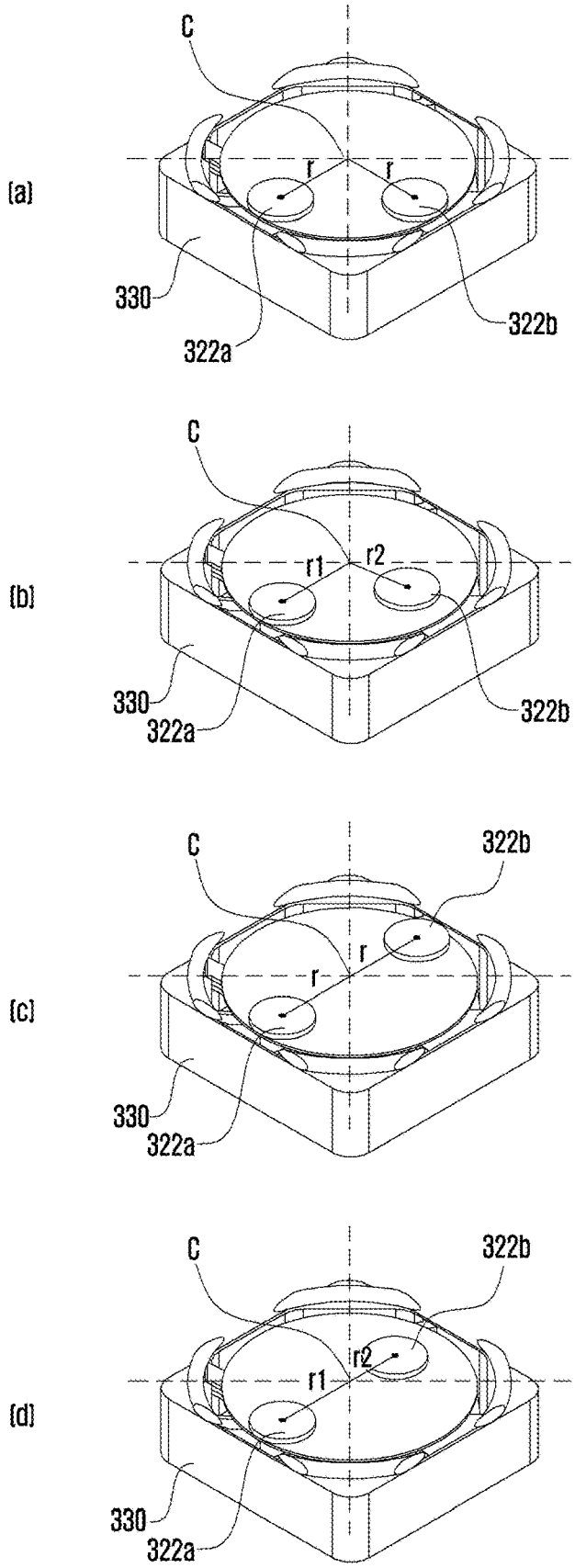
FIG. 6 is a perspective view showing various embodiments for arrangement of magnets attached to a shield plate in the portable massage device shown in FIGS. 3 to 5.

FIG. 6 is a perspective view showing various embodiments for arrangement of magnets attached to a shield plate in the portable massage device shown in FIGS. 3 to 5.

Referring to FIG. 6 together with FIGS. 3 to 5, in the portable massage device 300, the magnets 322 may be provided on the shield plate 320 in various patterns such that the shield plate 320 vibrates when the motor 350 rotates. Although FIGS. 4 and 6 show the shield plate 320 formed in a circular plate shape, this is exemplary only. Alternatively, the shield plate 320 may be formed in any other shape such as a regular polygonal plate shape or an elliptical plate shape.

Specifically, two magnets 322*a* and 322*b* may be arranged eccentrically at the same distance (r) from the center (C) of the shield plate 320 (see (a) of FIG. 6), or arranged eccentrically at different distances (r1 and r2) from the center (C) of the shield plate 320 (see (a) of FIG. 6). In these cases, the two magnets 322*a* and 322*b* may have the same weight or different weights. In addition, the two magnets 322*a* and 322*b* having different weights may be arranged symmetrically at the same distance (r) from the center (C) of the shield plate 320 (see (c) of FIG. 6), or the two magnets 322*a* and 322*b* having the same weight may be arranged symmetrically at different distances (r1 and r2) from the center (C) of the shield plate 320 (see (d) of FIG. 6).

FIG. 6 shows four examples in which the magnets 322 (e.g., two magnets 322*a* and 322*b*) are arranged on the shield plate 320 to generate vibrations when the motor 350 rotates, but this is exemplary only. Alternatively, any other arrangement of the magnets on the shield plate 320 may be possible. For example, only one magnet 322*a* or 322*b* may be attached to the shield plate 320, or three magnets of the same weight may be attached asymmetrically with respect to the center (C) of the shield plate 320.

Figure 7:
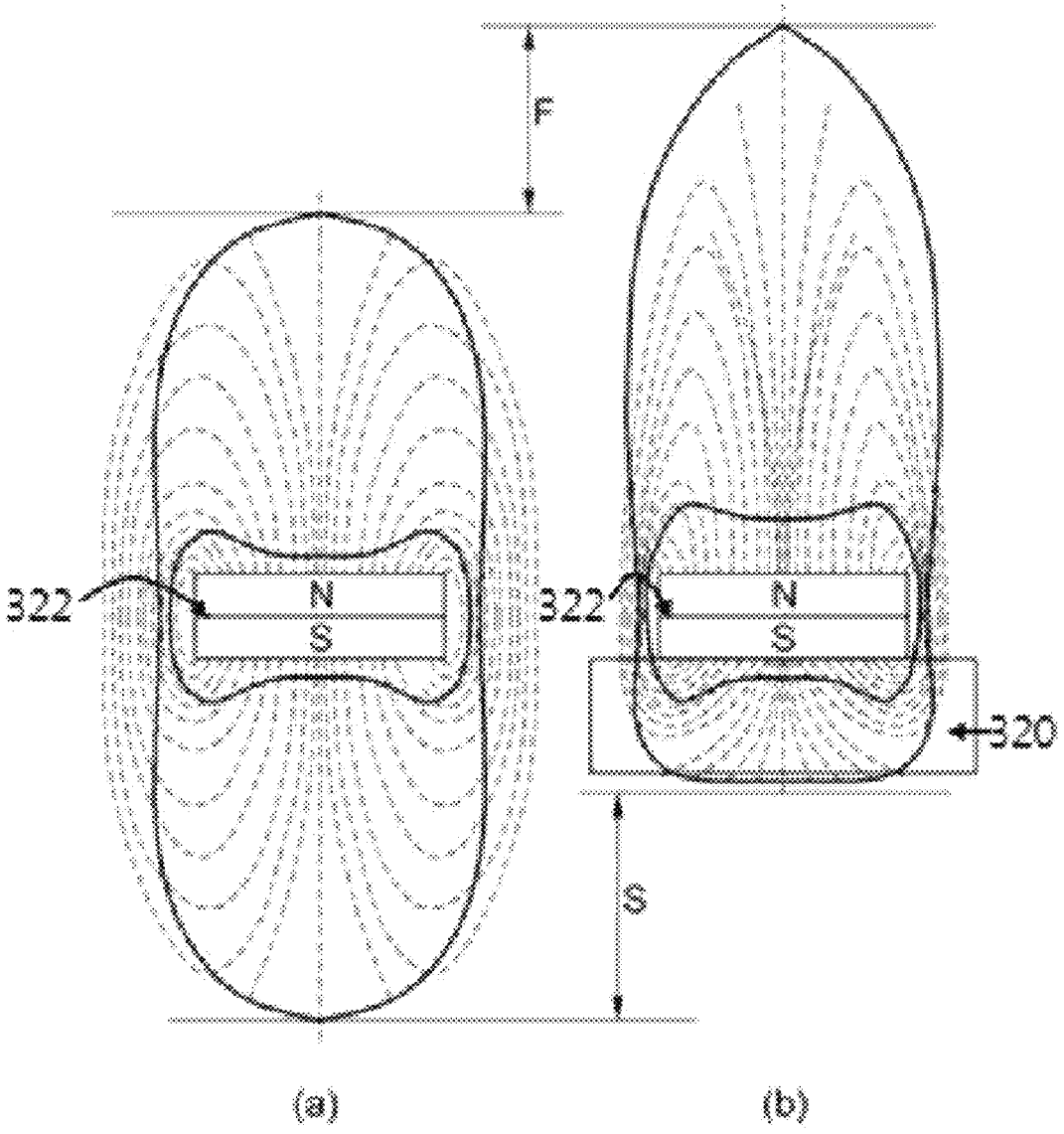
FIG. 7 is a view showing a magnetic shield phenomenon by a shield plate used in the portable massage device shown in FIG. 6.

FIG. 7 is a view showing a magnetic shield phenomenon by a shield plate used in the portable massage device shown in FIG. 6.

As shown in (a) of FIG. 7 where the portable massage device 300 has no shield plate, the magnet 322 attached to the shield plate 320 has an upper N pole and a lower S pole. In this case, lines of magnetic force (depicted by dotted lines) beginning on the N pole and terminating on the S pole are distributed almost symmetrically.

On the contrary, in case of an embodiment of the disclosure where there is the shield plate 320, the magnetic force lines beginning on the N pole are distributed wider upward, and the magnetic force lines terminating on the N pole are distributed narrower within the shield plate 320. That is, a magnetic shield is accomplished such that the magnetic force lines are hardly distributed outside the shield plate 320. As a result, the magnetic force is increased at the N pole of the magnet 322 as indicated by F, whereas the magnetic force is reduced at the S pole as indicated by S. Therefore, in the portable massage device 300 according to an embodiment of the disclosure, the magnetic shield is performed according to the use of the shield plate 320, and thereby the magnetic force is increased above the shield plate 320 in comparison with case of using no shield plate.

The shield plate 320 shown in FIG. 7 may be formed of a metal plate such as an iron plate. Therefore, even if the portable massage device 300 according to an embodiment is implemented in a thin, compact, and ultra-light form, the magnet 322 can provide a sufficient magnetic force and thereby provide a blood improvement effect. Although FIG. 7 shows the magnetic shield for one magnet 322, this is exemplary only. Even in case of the pair of magnets 322*a* and 322*b* shown in FIG. 6, the magnetic force may be increased above the shield plate 320 by the magnetic shield effect of FIG. 7 in comparison with case of using no shield plate. In addition, the magnetic shield effect of FIG. 7 may be applied to a case where each of the pair of magnets 322*a* and 322*b* has an upper N pole and a lower S pole, and vice versa, and a case where one of the pair of magnets 322*a* and 322*b* has an upper N pole and a lower S pole, whereas the other magnet has an upper S pole and a lower N pole.

Figure 8:
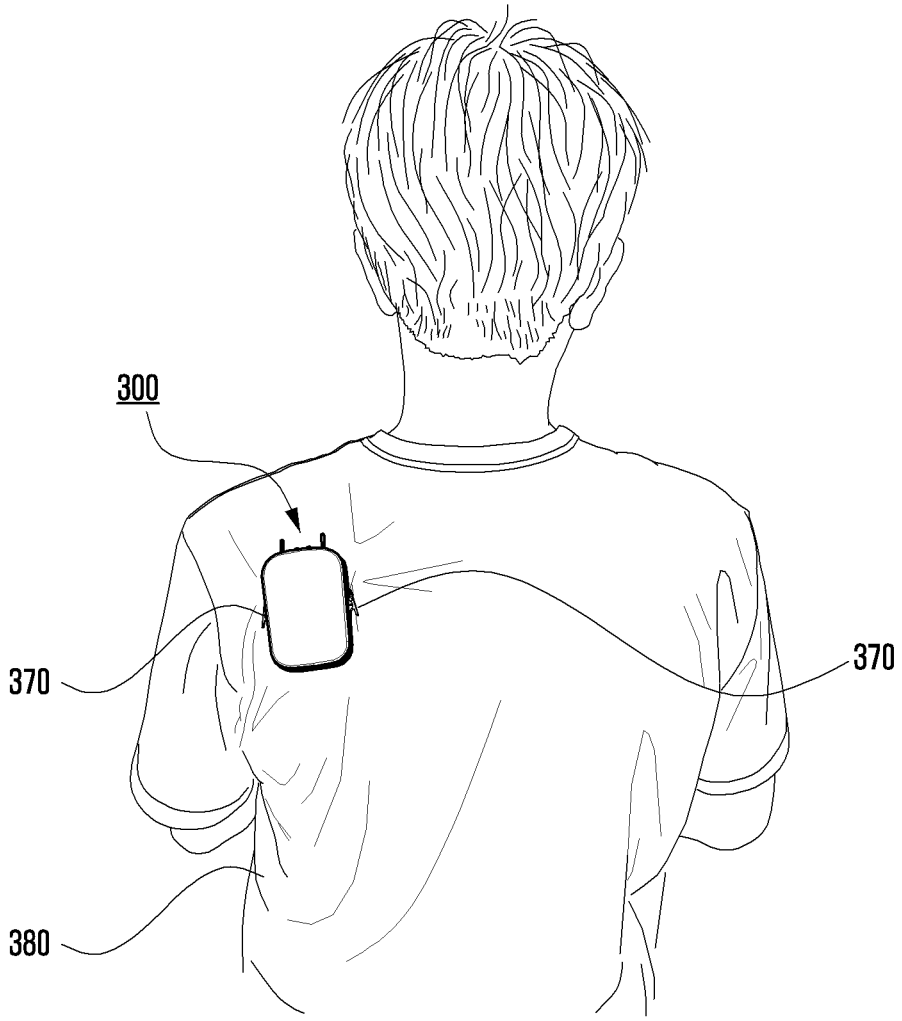
FIG. 8 is a view showing a state of using the portable massage device shown in FIGS. 3 to 6.

FIG. 8 is a view showing a state of using the portable massage device shown in FIGS. 3 to 6.

Referring to FIG. 8 together with FIGS. 3 to 6, the portable massage device 300 is clamped to a user's upper garment 380 through the at least one clamp 370. Therefore, the user can use very conveniently the portable massage device 300 without a need to hold the portable massage device 300 by hand. Alternatively, the at least one clamp 370 may be clamped to any other part of the user such as, for example, a user's socks, hat, or hair.

Figure 9:
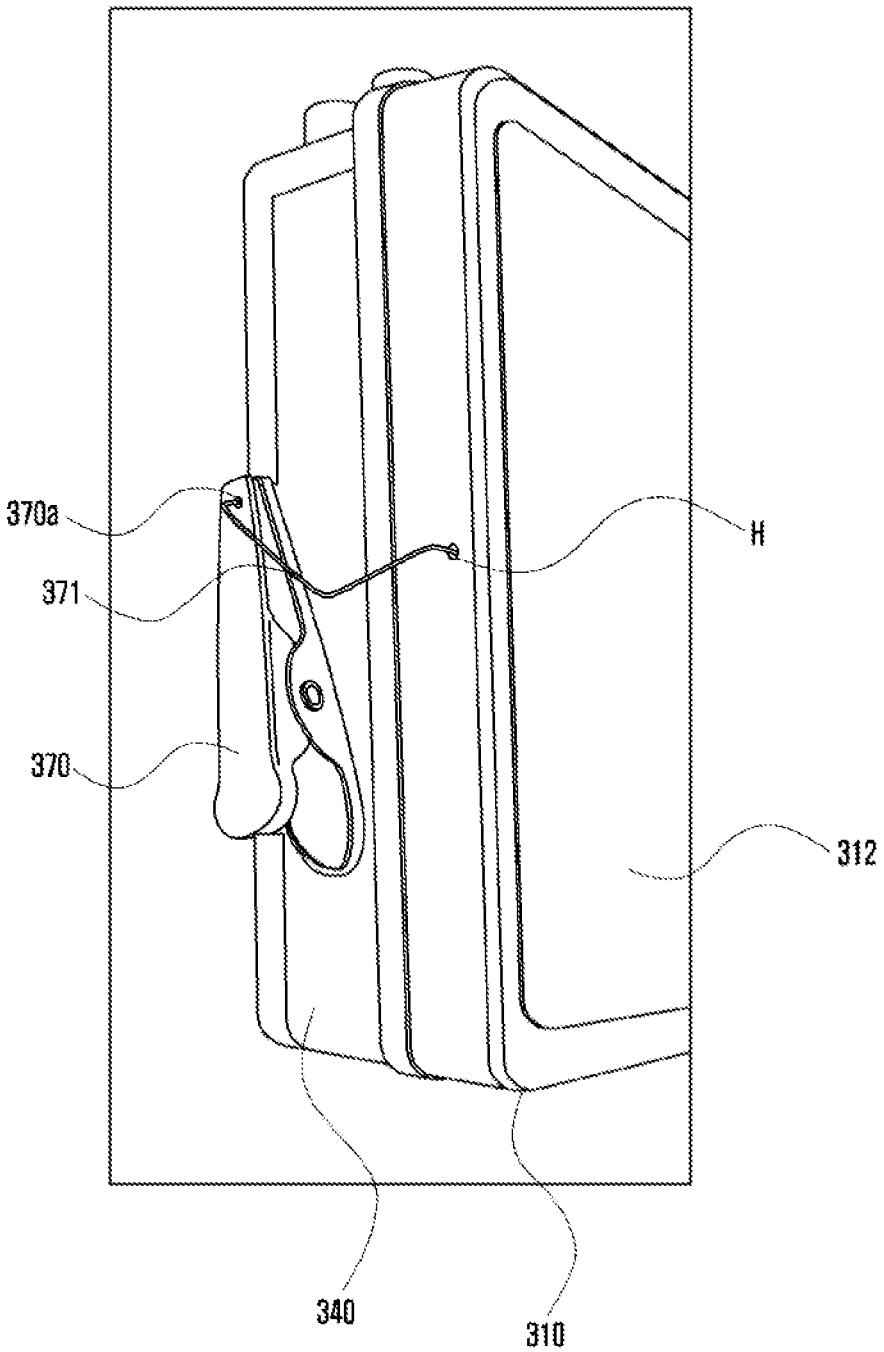
FIG. 9 is a view showing a release preventing pin further provided in the portable massage device shown in FIGS. 3 to 6 and 8.
Figure 10:
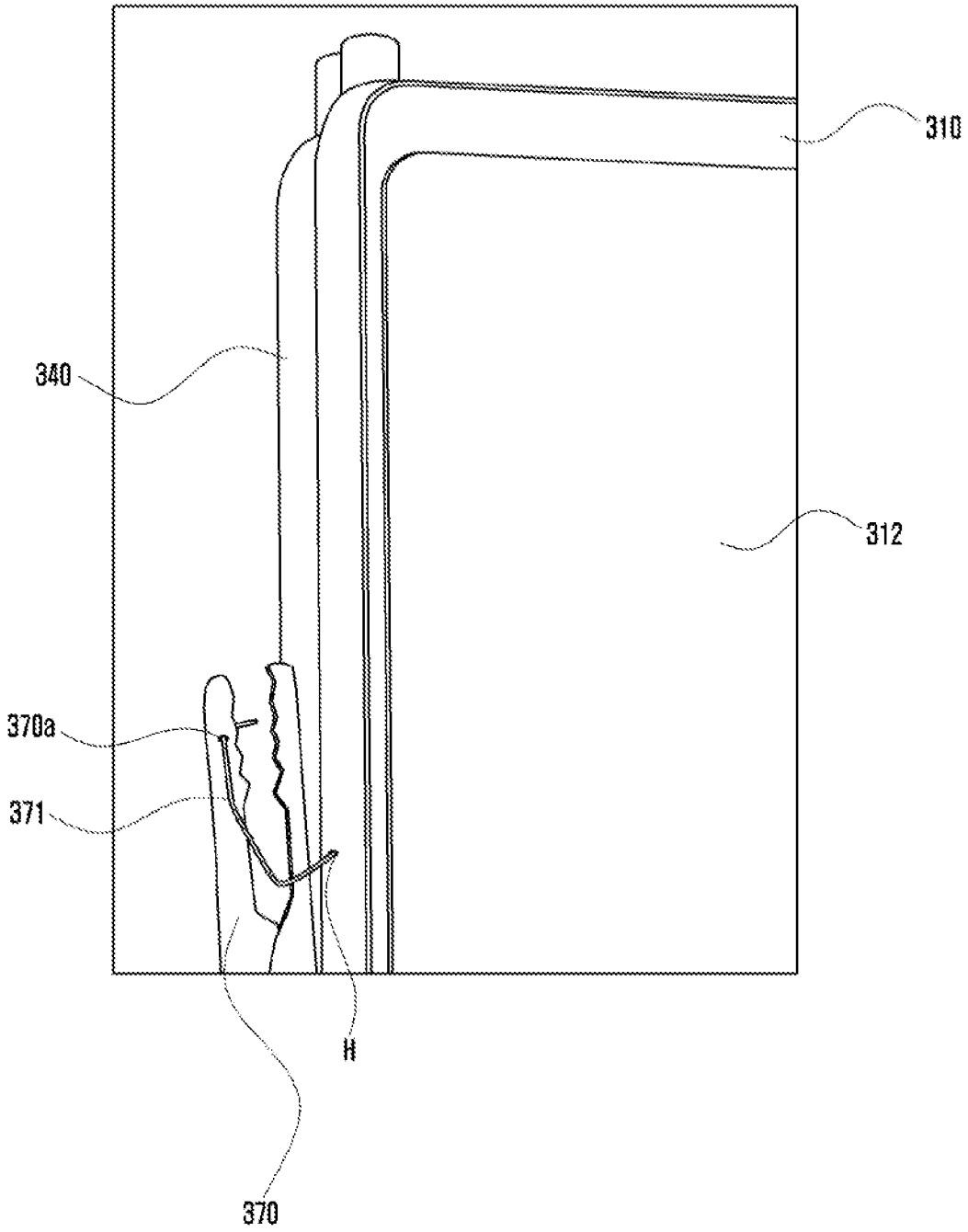
FIG. 10 is a view showing an operating state of a clamp provided with the release preventing pin shown in FIG. 9.

FIG. 9 is a view showing a release preventing pin further provided in the portable massage device shown in FIGS. 3 to 6 and 8. FIG. 10 is a view showing an operating state of a clamp provided with the release preventing pin shown in FIG. 9.

Referring to FIGS. 9 and 10 together with FIGS. 3 to 6 and 8, when the portable massage device 300 is attached to the user's upper garment 380 or the like through the clamp 370 as shown in FIG. 8, the clamp 370 may be detached from the user's upper garment 380 by a self-weight or an external impact during the use of the portable massage device 300. In order to prevent this, the portable massage device 300 may further include a release preventing pin 371.

Specifically, the release preventing pin 371 has one end fixed to one side of the first housing 340 or the second housing 310, and the other end inserted into one arm of the clamp 370 and protruded to a clamped area. The one side of the first housing 340 or the second housing 310 may have a fixing hole (H) to which the one end of the release preventing pin 371 is fixed. The one arm of the clamp 370 may have a through hole 370*a* into which the other end of the release preventing pin 371 is inserted.

The release preventing pin 371 is operated together with the clamp 370. When the clamp 370 is clamped to the user's upper garment 380, the release preventing pin 371 is also engaged with the user's upper garment 380. Therefore, the release preventing pin 371 can prevent the clamp 370 from being detached from the user's upper garment 380 by a self-weight or an external impact during the use of the portable massage device 300.

Figure 11:
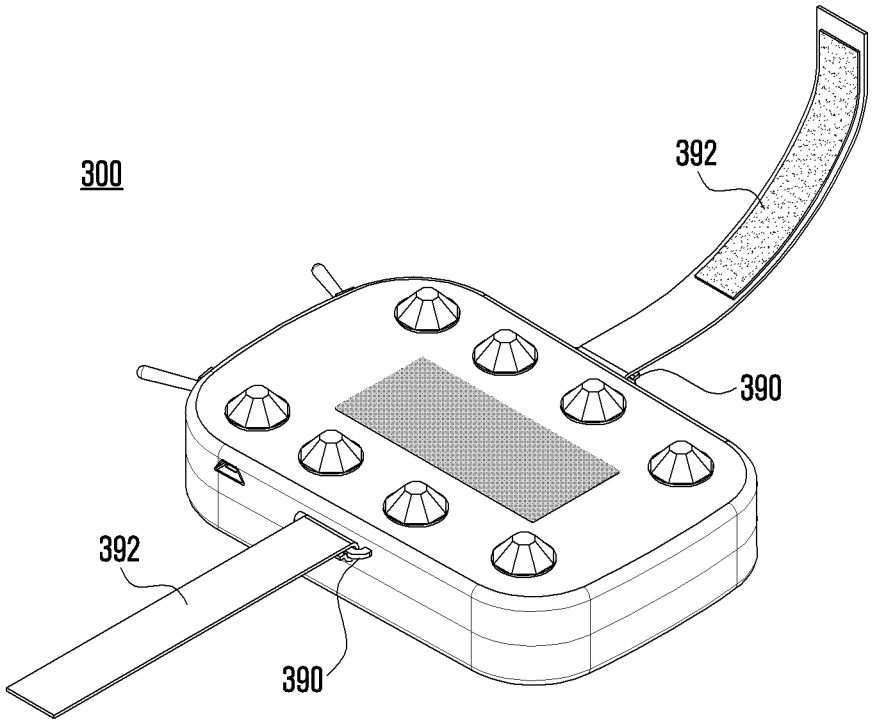
FIG. 11 is a perspective view showing a first example in which the portable massage device shown in FIGS. 3 to 6 and 8 includes a fastening member.

FIG. 11 is a perspective view showing a first example in which the portable massage device shown in FIGS. 3 to 6 and 8 includes a fastening member.

Referring to FIG. 11, the portable massage device 300 may further include, instead of the at least one clamp 370 shown in FIGS. 3 to 5, a fastening member 392 provided through sides of the portable massage device 300. The fastening member 392 may be implemented in part or in whole by, for example, a Velcro tape or a buckle type fastener. Thus, the user can use the portable massage device 300 while wearing it on a part of the user's body such as hand, foot, forehead, neck, or shoulder through the fastening member 392. The portable massage device 300 may also include a fixing ring 390 to fix the fastening member 392 to the side of the portable massage device 300.

Figure 12:
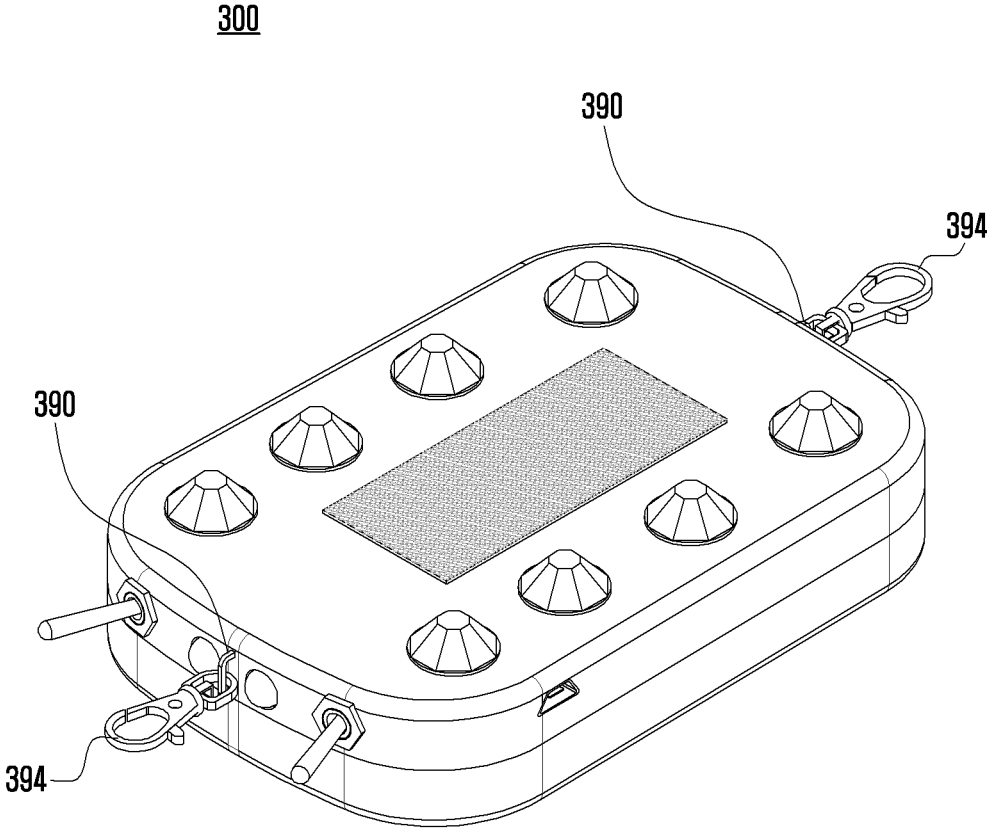
FIG. 12 is a perspective view showing a second example in which the portable massage device shown in FIGS. 3 to 6 and 8 includes a fastening member.

FIG. 12 is a perspective view showing a second example in which the portable massage device shown in FIGS. 3 to 6 and 8 includes a fastening member.

In this example shown in FIG. 12, the portable massage device 300 may further include at least one holder 394 and at least one fixing ring 390. The at least one holder 394 is provided to hang a strip (not shown) that detachably attaches the portable massage device 300 to the user's body (e.g., hand, foot, forehead, neck, back, shoulder, etc.). The at least one fixing ring 390 is coupled to the at least one holder 394. FIG. 12 shows the at least one holder 394 connected to the portable massage device 300 through the at least one fixing ring 390, but the at least one holder 394 may be directly and fixedly connected to the side of the portable massage device 300 in an alternative example.

Figure 13:
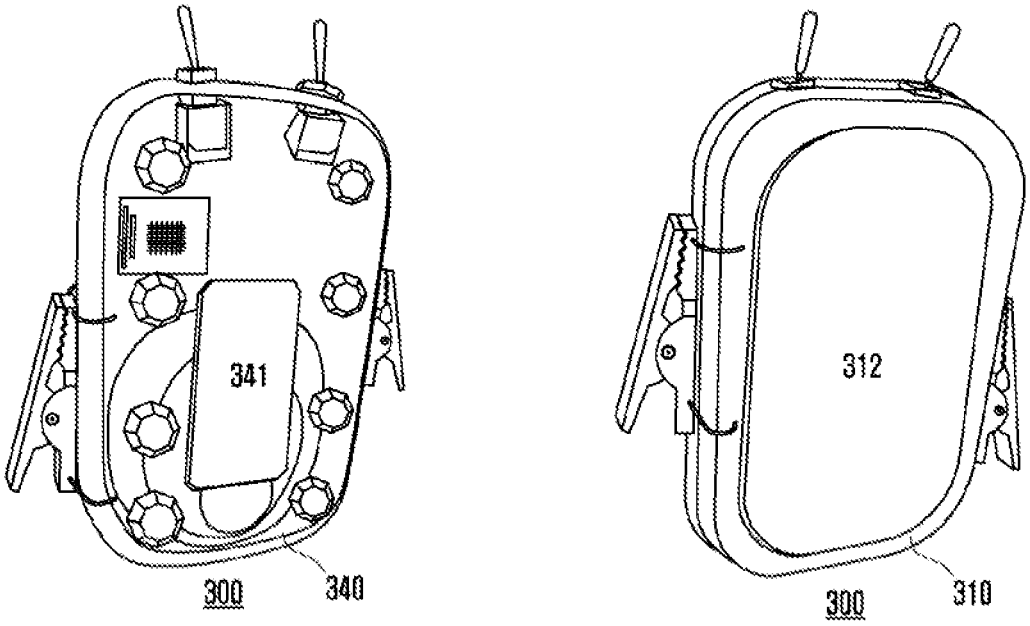
FIG. 13 is a view showing a first actual implementation of the portable massage device shown in FIGS. 3 to 6 and 8.

FIG. 13 is a view showing a first actual implementation of the portable massage device shown in FIGS. 3 to 6 and 8.

Referring to FIG. 13, in the first actual implementation of the portable massage device 300, each of the first housing 340 and the second housing 310 is approximately 8 cm long, approximately 5.2 cm wide, and approximately 1.5 cm high. In addition, the total weight of the portable massage device 300 is 68 g. Thus, the portable massage device 300 has a thin, compact, and ultra-lightweight structure. The first housing 340 and the second housing 310 are each made of a transparent plastic material, and a mirror 312 is provided on an upper surface of the second housing 310.

Figure 14:
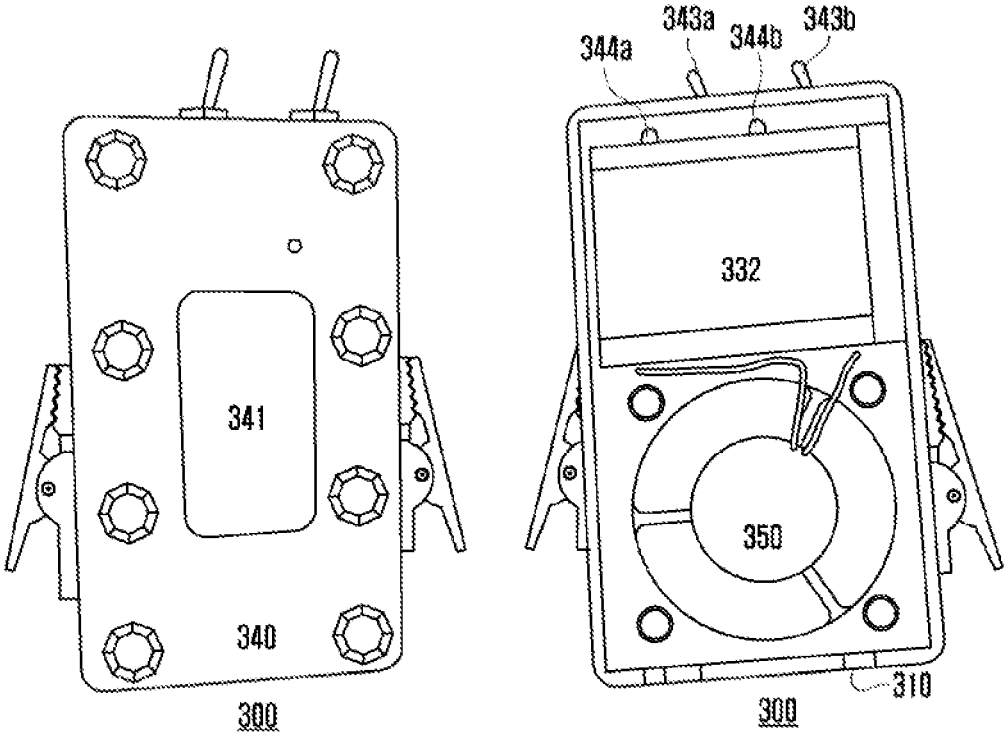
FIG. 14 is a view showing a second actual implementation of the portable massage device shown in FIGS. 3 to 6 and 8.

FIG. 14 is a view showing a second actual implementation of the portable massage device shown in FIGS. 3 to 6 and 8.

Referring to FIG. 14, the portable massage device 300 according to the second actual implementation has the substantially same structure as that of the first actual implementation shown in FIG. 13 except that the first housing 340 and the second housing 310 are each made of an opaque plastic material. In addition, FIG. 14 shows that the first and second switches 343*a* and 343*b* turn on the battery 332 to perform the rotation operation of the motor 350 and the heating operation of the heating plate 341, and also shows that the first and second indicators 344*a* and 344*b* emit a blue light and a red light to indicate normal operating states of the motor 350 and the heating plate 341, respectively.

As described hereinbefore, the portable massage device 300 according to various embodiments of the disclosure has a thin, compact, and ultra-lightweight structure and also has the following advantages. 1) The portable massage device 300 is portable, convenient, and easy to use. 2) The portable massage device 300 can provide sufficient effects of massage, blood circulation, and thermal poultice. 3) The portable massage device 300 can be used without requiring a user's grip because of the thin, compact, and ultra-lightweight structure, and also can be used on a user's affected part or pain part for a long time because of reduced power consumption. 4) Because the motor 350, the rotating member 318, and the shield plate 320 with the magnet 322 attached, which are main components of the portable massage device 300, are provided in one standardized case 330, it is possible to realize modularization of such components. 5) The portable massage device has a great reduction in manufacturing cost and time, and therefore a mass production is possible.

While the disclosure has been particularly shown and described with reference to exemplary embodiments thereof, it will be understood by those skilled in the art that various changes in form and details may be made therein without departing from the scope of the subject matter as defined by the appended claims.

What is claimed is:

1. A portable massage device comprising:

a first housing including a plurality of acupressure protrusions formed on an upper surface thereof and spaced apart from each other;

a battery supplying power;

a motor connected to the battery to be turned on/off;

a rotating member mounted to surround the motor;

a shield plate provided on the rotating member;

at least one magnet detachably attached to the shield plate so that the shield plate vibrates when the motor rotates, wherein the at least one magnet includes two magnets having different weights;

a case accommodating the motor;

a first switch connected to and controlling the battery to be turned on/off;

and a second housing detachably combined with the first housing, wherein the battery and the case are accommodated in the first housing or the second housing.

2. The portable massage device of claim 1, wherein the plurality of acupressure protrusions are implemented as LED devices capable of intermittent light emission.

3. The portable massage device of claim 1, wherein the case is implemented to have a standardized size to accommodate the motor, the rotating member, and the shield plate to which the at least one magnet is attached.

4. The portable massage device of claim 1, further comprising:

a heating plate provided on a surface of the first housing or the second housing; and a second switch connected to the heating plate through the battery.

5. The portable massage device of claim 4, further comprising:

a first indicator connected to both the first switch and the battery; and a second indicator connected to both the second switch and the battery.

6. The portable massage device of claim 5, wherein each of the first indicator and the second indicator is implemented as an LED device or a micro lamp.

7. The portable massage device of claim 5, further comprising:

a reflective plate formed behind the first indicator and the second indicator such that light emitted from the first and second indicators is focused and emitted in one direction.

8. The portable massage device of claim 1, wherein the battery is implemented as a replaceable battery or a rechargeable battery.

9. The portable massage device of claim 1, further comprising:

at least one clamp provided on a side of the first housing or the second housing.

10. The portable massage device of claim 9, further comprising:

a release preventing pin having one end fixed to one side of the first housing or the second housing, and having other end inserted into one arm of the clamp and protruded to a clamped area.

11. The portable massage device of claim 1, further comprising:

a fastening member provided through sides of the portable massage device so as to detachably attach the portable massage device to a user's body.

12. The portable massage device of claim 1, further comprising: at least one holder configured for hanging a strip that detachably attaches the portable massage device to a user's body.

13. The portable massage device of claim 1, further comprising: a mirror provided on a surface of the first housing or the second housing.

14. The portable massage device of claim 1, wherein each magnet is arranged eccentrically at a same distance or different distances from a center of the shield plate.

15. The portable massage device of claim 1, wherein each magnet is arranged symmetrically at a same distance from a center of the shield plate or at different distances from the center of the shield plate.

* * * * *